US008667920B2

(12) United States Patent
Faires

(10) Patent No.: US 8,667,920 B2
(45) Date of Patent: Mar. 11, 2014

(54) UNDERWATER DIVER GLIDER

(76) Inventor: Glenn Faires, Gallows Bay (AN)

( * ) Notice: Subject to any disclaimer, the term of this patent is extended or adjusted under 35 U.S.C. 154(b) by 232 days.

(21) Appl. No.: 13/230,463

(22) Filed: Sep. 12, 2011

(65) Prior Publication Data

US 2013/0061793 A1 Mar. 14, 2013

(51) Int. Cl.
*B63C 11/46* (2006.01)

(52) U.S. Cl.
USPC ..... 114/315

(58) Field of Classification Search
USPC ..... 114/312–339; 405/185–191; D21/810
See application file for complete search history.

(56) References Cited

U.S. PATENT DOCUMENTS

| | | | | |
|---|---|---|---|---|
| 3,157,145 | A * | 11/1964 | Farris et al. | 114/332 |
| 6,328,622 | B1 | 12/2001 | Geery | |
| 7,328,669 | B2 | 2/2008 | Adams | |
| 7,448,340 | B1 * | 11/2008 | Gibson | 114/315 |
| 2008/0300742 | A1 * | 12/2008 | Weaver et al. | 701/21 |

* cited by examiner

*Primary Examiner* — Edwin Swinehart
(74) *Attorney, Agent, or Firm* — Trego, Hines & Ladenheim, PLLC

(57) ABSTRACT

An underwater diver glider includes: a body having a nose and a tail, opposed left and right sides, and spaced-apart upper and lower walls, the body including: an interior space defined between the upper and lower walls that is configured to contain a gas vessel therein; an air chamber defined in an upper portion of the body beneath the upper wall; and an outlet positioned in the body near the tail and below the upper wall, in communication with the air chamber; a pair of wings extending from left and right sides of the body, respectively; and a handle extending axially aft from the body.

17 Claims, 8 Drawing Sheets

UNDERWATER DIVER GLIDER

BACKGROUND OF THE INVENTION

This invention relates generally to underwater diving, and more particularly to apparatus for propelling a diver underwater.

Underwater diving is a popular activity. One common diving method is SCUBA diving (named for Self-Contained Underwater Breathing Apparatus), in which a diver is provided with a portable tank containing compressed breathable gas. The gas is metered to the diver through a regulator. Another type is breath-hold diving in which the diver uses his own lung capacity while swimming underwater.

It is often desirable to cover more distance underwater than a diver could cover solely by swimming with his limited lung capacity or breathing gas supply. It is known, for example, to provide a thruster or diver propulsion unit which pushes or pulls a diver through the water using a propeller powered by an electric motor connected to an electrical power supply.

It is also known to extend a diver's range with an underwater glider. An underwater glider has wings that create a drag force and enable a diver to travel horizontally a substantial distance while rising or falling in a body of water. Known underwater gliders are complex, and therefore have the potential for failure. Known gliders require electrically-powered controllers, or require a diver's air supply and therefore cannot be used for breath-hold diving. These devices are also expensive and can be noisy and send out electrical signals that can be disturbing to marine life.

Accordingly, there is a need for an underwater glider that is mechanically simple and is suitable for both SCUBA diving and breath-hold dives.

BRIEF SUMMARY OF THE INVENTION

This need is addressed by the present invention, which provides an underwater glider that creates positive buoyancy by selectively trapping a gas bubble. Creation and dumping of the gas bubble are manually controlled by a diver.

According to one aspect of the invention, an underwater glider includes: a body having a nose and a tail, opposed left and right sides, and spaced-apart upper and lower walls, the body including: an interior space defined between the upper and lower walls that is configured to contain a gas vessel therein; an air chamber defined in an upper portion of the body beneath the upper wall; and an outlet positioned in the body near the tail and below the upper wall, in communication with the air chamber; a pair of wings extending from left and right sides of the body, respectively; and a handle extending axially aft from the body.

According to another aspect of the invention, an underwater glider includes: a body having a nose and a tail, opposed left and right sides, and spaced-apart upper and lower walls, the body including: an air chamber defined in an upper portion of the body beneath the upper wall; and an outlet positioned in the body near the tail and below the upper wall, in communication with the air chamber; a gas cylinder mounted inside the body; a pair of wings extending from left and right sides of the body, respectively, the wings being resiliently flexible in an up-and-down direction; and a handle extending axially aft from the body.

According to another aspect of the invention, a method is provided of operating an underwater glider that comprises a body with a nose and a tail, the body including a gas vessel, an air chamber, an outlet positioned near the tail in communication with the air chamber, a pair of wings extending from left and right sides of the body, respectively, and a handle extending axially aft from the body. The method includes: (a) generating positive buoyancy in the glider by filling the air chamber with a gas bubble from the gas vessel; (b) climbing upward through a body of water, wherein drag force acting on the wings generates a horizontal component of motion; (c) pitching the glider to a nose-down position, so as to release the gas bubble from the air chamber through the outlet and allow water to fill the air chamber, thereby generating negative buoyancy in the glider, and (d) gliding downward through the body of water, wherein drag force acting on the wings generates a horizontal component of motion.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
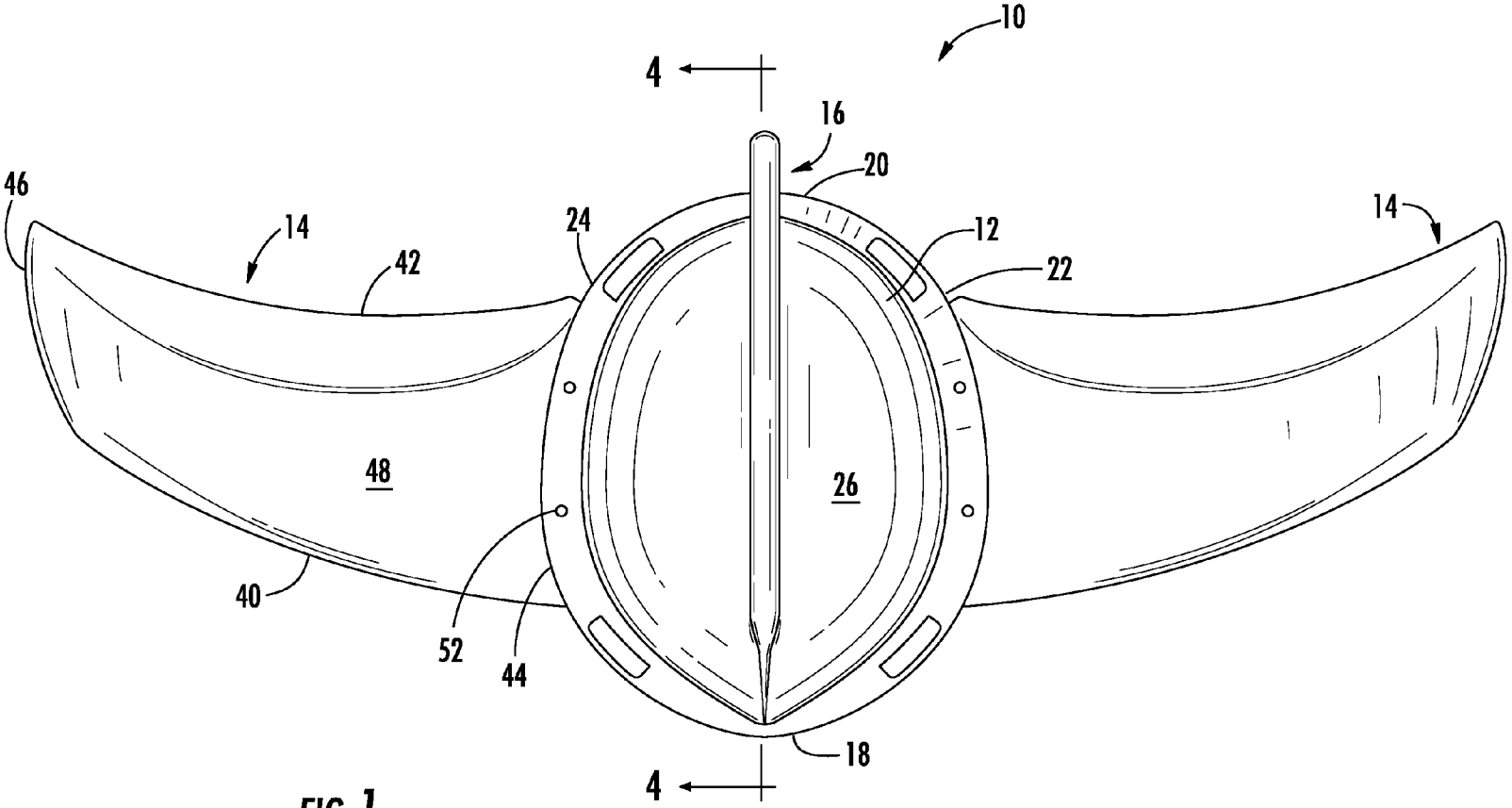
FIG. 1 is a top plan view of a glider constructed according to an aspect of the present invention.
Figure 2:
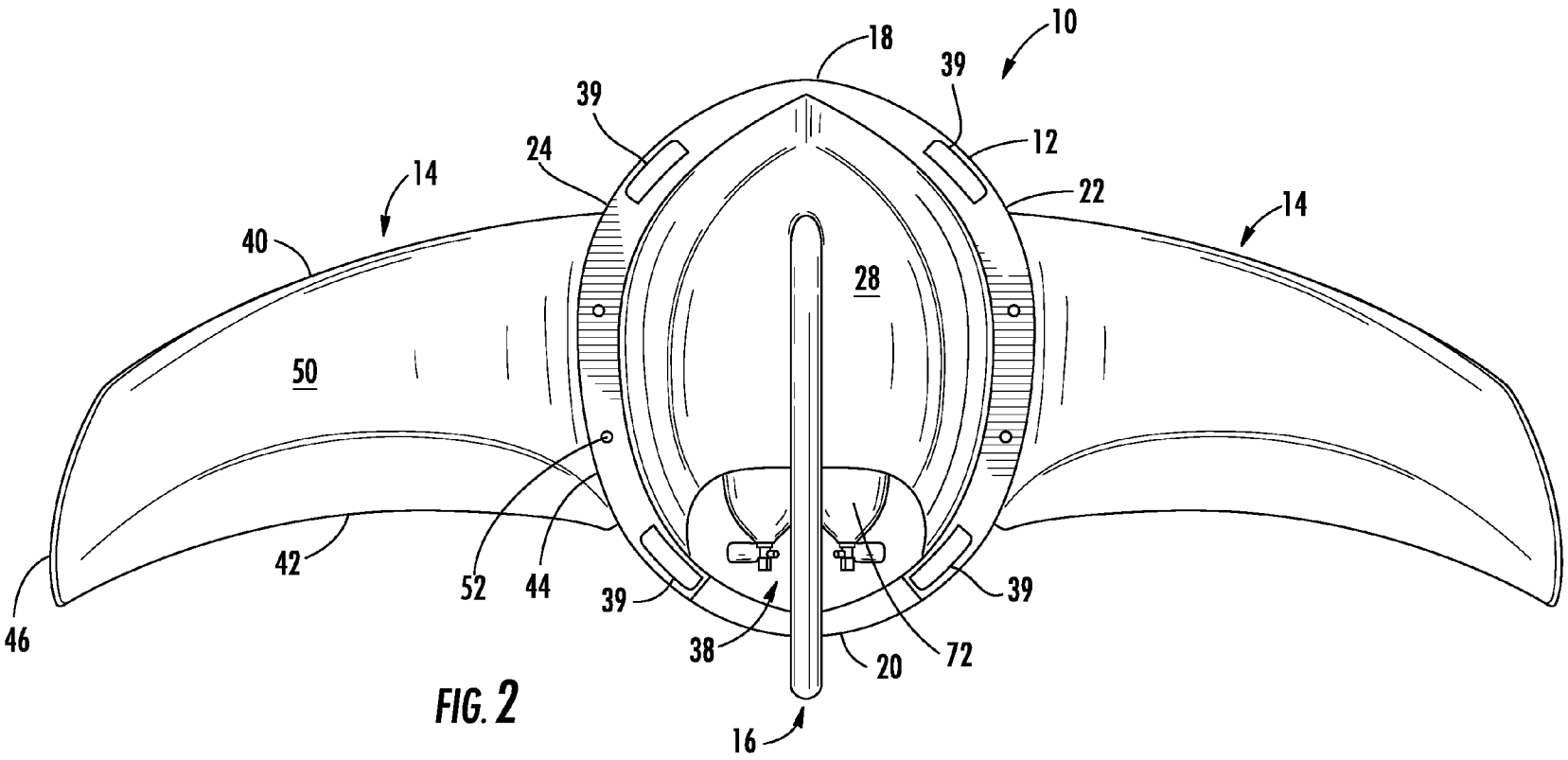
FIG. 2 is a bottom plan view of the glider of FIG. 1.
Figure 3:
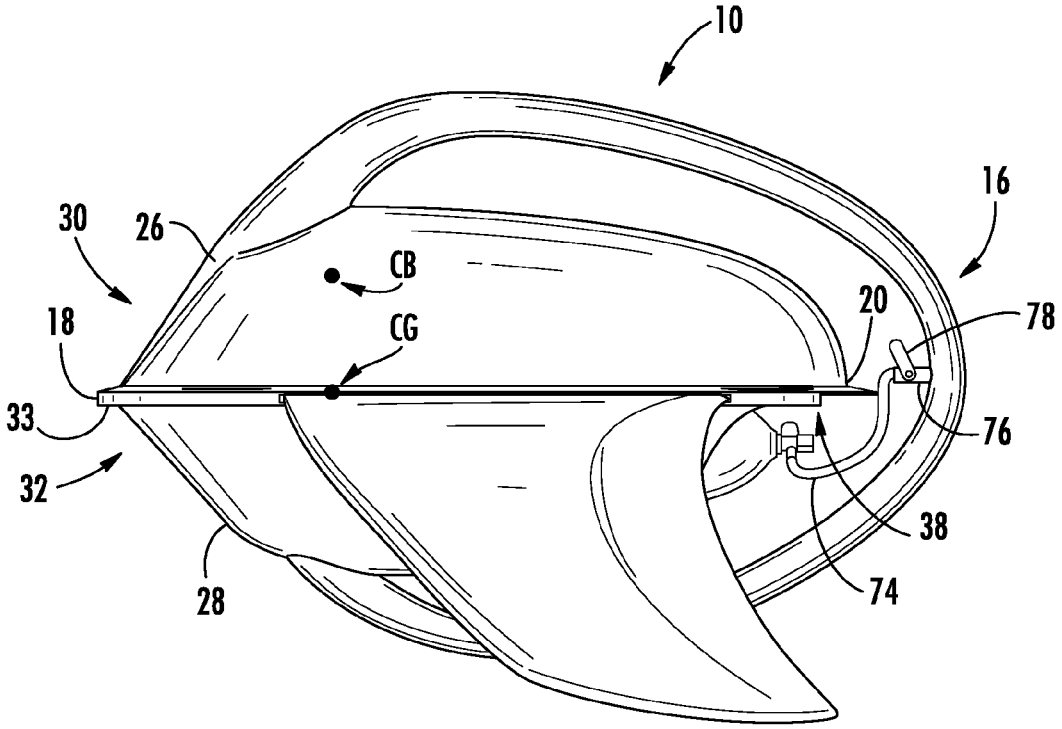
FIG. 3 is side elevational view of the glider of FIG. 1.

Referring to the drawings wherein identical reference numerals denote the same elements throughout the various views, FIGS. 1-5 depict an exemplary underwater glider 10 constructed according to an embodiment of the present invention. For simplicity, it may be referred to herein simply as a "glider". The glider 10 includes a body 12 with laterally-extending wings 14 and a handle 16.

Figure 4:
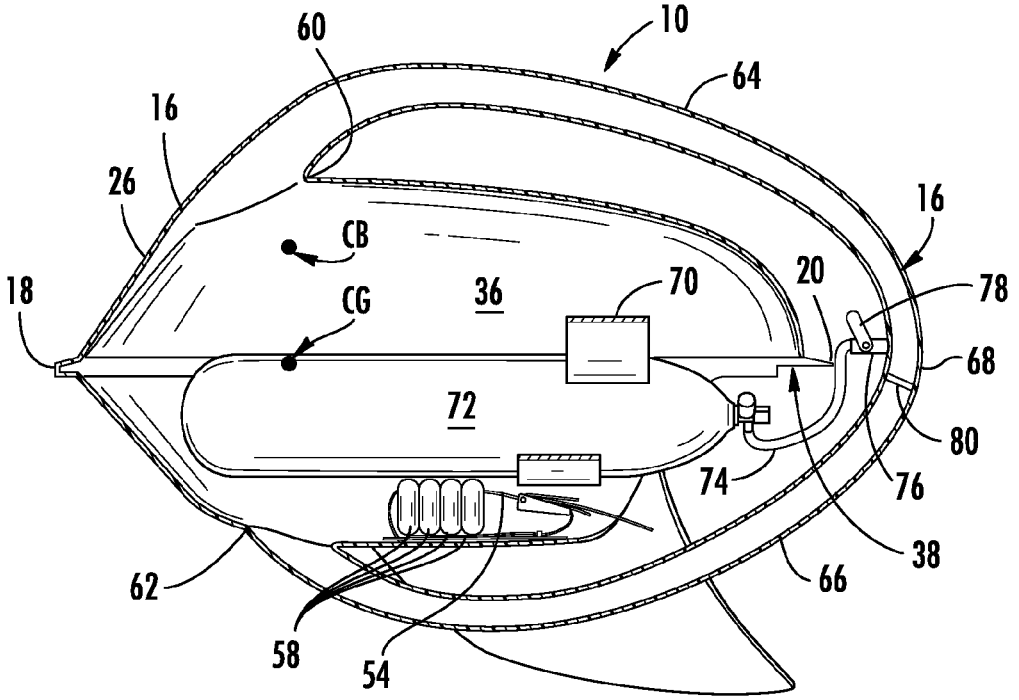
FIG. 4 is a cross-sectional view taken along lines 4-4 of FIG. 1.
Figure 5:
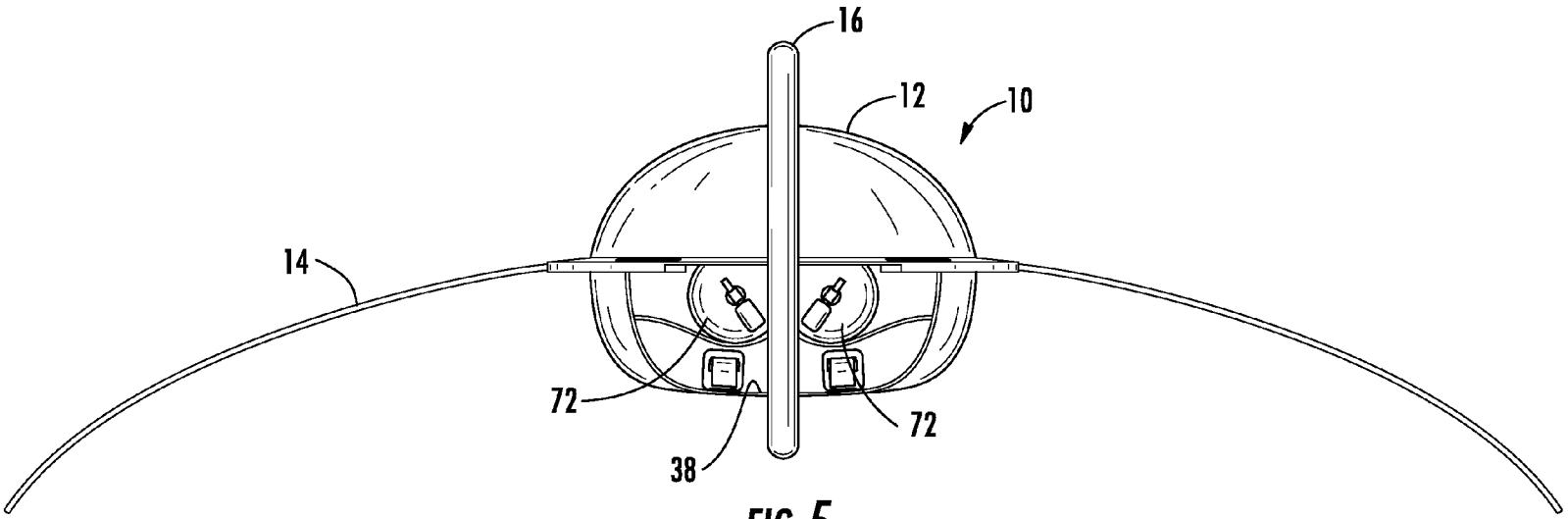
FIG. 5 is a rear elevational view of the glider of FIG. 1.

The body 12 is a hollow, streamlined structure with a nose 18, a tail 20, opposed left and right sides 22 and 24, and opposed upper and lower walls 26 and 28. In the illustrated example, the body 12 is constructed from an upper shell 30 which defines the upper wall 26, and a lower shell 32 which defines the lower wall 28. The upper and lower shells 30 and 32 are joined to each other at a beltline 33, for example by using adhesives, fasteners, or thermal bonding. As best seen in FIG. 4, the upper wall 26 of the body 12 defines an air chamber 36 which communicates with an outlet 38 formed in the lower portion of the body 12 near the tail 20. Optionally, lifting handles 39 may be provided to facilitate launching the glider 10 and retrieving it from the water.

The body 12 may be constructed from any material that is water-resistant and capable of maintaining the desired shape. It is desirable to construct the body 12 from a material of relatively low cost and of a light weight. One example of a suitable material for the body is a composite such as glass-reinforced plastic (e.g. fiberglass/epoxy composite). Other composites such as a carbon fiber/epoxy system, or materials such as molded polymers may also be suitable.

Each wing 14 is laterally-elongated structure including a leading edge 40, a trailing edge 42, a root 44, and a tip 46, and opposed upper and lower surfaces 48 and 50. The wings 14 have a moderate back-sweep from root 44 to tip 46. The wings 14 do not require any particular cross-sectional airfoil shape, so long as they are effective to generate a lift force directed at least partially forwards to improve forward motion and efficiency. A symmetrical hydrofoil shape may be helpful. The wings' chordwise length (from leading edge 40 to trailing edge 42) is significantly greater than their thickness (from upper surface 48 to lower surface 50). The root 44 of each wing 14 is attached to the body 12 at or near the beltline 33, for example using the illustrated bolts 52. The wings 14 are constructed so as to be able to resiliently flex up or down in response to movement of the glider 10, as will be explained in more detail below. The flexibility may be imparted by selection of the physical configuration and/or material selection for the wings 14. In the illustrated example, the wings 14 are at their thickest near the leading edge 40 and the root 44, tapering off in thickness towards the trailing edge 42 and the tip 46. The wings 14 may be constructed from any material that is water-resistant and capable of maintaining the desired shape. It is desirable to construct the wings 14 from a material of relatively low cost and of a light weight. One example of a suitable material for the wings 14 is a composite such as glass-reinforced plastic (e.g. fiberglass/epoxy composite). Other composites such as a carbon fiber/epoxy system, or materials such as molded polymers may also be suitable. In a case where the wings 14 are made from glass-reinforced epoxy or a similar material, flexibility may be imparted by using fewer glass fabric plies or reinforcing fibers than would be used to form a rigid structure.

The body 12 includes provisions for carrying one or more weights. In the illustrated example, weight straps 54 are integrally formed on or attached to the lower wall 28, and standard diving weights 58 of a known type can be secured to the weight straps 54. The purpose of the weights 58 is to adjust the buoyancy of the glider 10 as well as the axial location of its center of gravity, as will be explained in more detail below, and to increase the negative buoyancy energy acting on the wings 14.

The handle 16 generally defines a large axially-elongated "C"-shape in side elevation view and is mounted in the lateral center of the body 12. A first end 60 of the handle 16 is mounted to the upper wall 26 near the nose 18, and a second end 62 of the handle 16 is mounted to the lower wall 28 near the nose 18. For reference purposes, the complete handle 16 can be thought of as including an upper leg 64 extending generally axially from the first end 60 to a point aft of the tail 20, a lower leg 66 extending generally axially from the second end 62 to a point aft of the tail 20, and a vertical leg 68 disposed aft of the tail 20 and interconnecting the aft ends of the upper and lower legs 64 and 66.

The interior space in the body 12 between the upper and lower walls 26 and 28 is configured to contain one or more gas vessels pressurized with compressed gas. Nonlimiting examples of suitable gases include compressed atmospheric air and other oxygen-containing gas blends. The gas vessel could be a separate component. It could alternatively be a permanent part of the body 12 (e.g., it could be formed integral to the body 12 or it could be permanently installed in the body 12). In the illustrated example (best seen in FIG. 4) a bracket 70 is disposed inside the body 12 and is configured to hold two gas cylinders 72 in place in a side-by-side configuration. The gas cylinders 72 may be standard items of the type commonly used to provide breathing air to a SCUBA diver. For example, they may be aluminum cylinders designated "AL80" with a capacity of about 2.2 $m^3$ (77 $ft.^3$) of gas at about 21 mPa (3000 psi).

Means are provided to permit a diver to selectively charge the air chamber 36 from the gas cylinders 72. In the illustrated example, a valve assembly includes a supply line 74 connected to the gas cylinders 72 and to a valve 76 which is operated by a lever 78. The body of the valve 76 is received in the hollow interior of the handle 16. A bulkhead 80 is positioned in the handle 16 just below the valve 76. Accordingly, a fluid flow path exists from the gas cylinders 72 through the supply line 74, the valve 76, and the handle 16 into the air chamber 36. Optionally, the diver may use the gas supply in the gas vessels for breathing through a conventional SCUBA regulator (not shown) as well as for charging the air chamber 36.

Several aspects of the glider 10 may be selected to improve its performance and controllability. One aspect is the center of gravity or "CG". This is defined as the point in a body where the gravitational force may be taken to act. The longitudinal position of the CG of the glider 10 (shown schematically in FIG. 3) depends on the mass distribution within the body 12. The CG may be biased towards the nose 18 such that, when the glider 10 is negatively buoyant, it will tend to pitch in the nose down direction. The CG position is chosen so that the nose-down pitching moment can be controlled by a diver with a reasonable amount of effort. The exact CG position may be determined through experimentation for a specific configuration of the glider 10, however as an example the CG may be located about ⅓ of the distance from the nose 18 to the tail 20.

Another aspect is the center of buoyancy or "CB". This is defined as the center of the gravity of the volume of water which a hull displaces. The longitudinal position of the CB will vary depending on the orientation (i.e. pitch, roll, and yaw angles) of the body 12. The CB may be biased towards the nose 18 (when the body 12 is level in pitch and roll) such that the glider 10 will tend to pitch the nose 18 up when the glider 10 is positively buoyant. The CB position is chosen so that the nose-up pitching moment can be controlled by a diver with a reasonable amount of effort. The exact CB position may be determined through experimentation for a specific configuration of the glider 10, however as an example the CB may be located about ⅓ of the distance from the nose 18 to the tail 20.

Another aspect is the shape, dimensions, and connection points of the handle 16. In particular, the handle 16 extends a substantial longitudinal distance over the body 12 and aft of the body 12, to allow for a variety of hand positions, as described in more detail below. The longitudinal position of the handle ends 60 and 62 may be aligned relative to the CG in the longitudinal direction, for example aligned with or somewhat forward of the CG, so as to provide the maximum possible leverage for the diver to control the pitch angle of the glider 10.

The glider 10 is operated as follows. First, charged gas cylinders 72 are mounted in the bracket 70 and connected to the valve 76. Weights are attached to the weight straps 54 sufficient to give the glider 10 a negative buoyancy when there is no gas in the air chamber 36, and to position the CG as desired.

Figure 6:
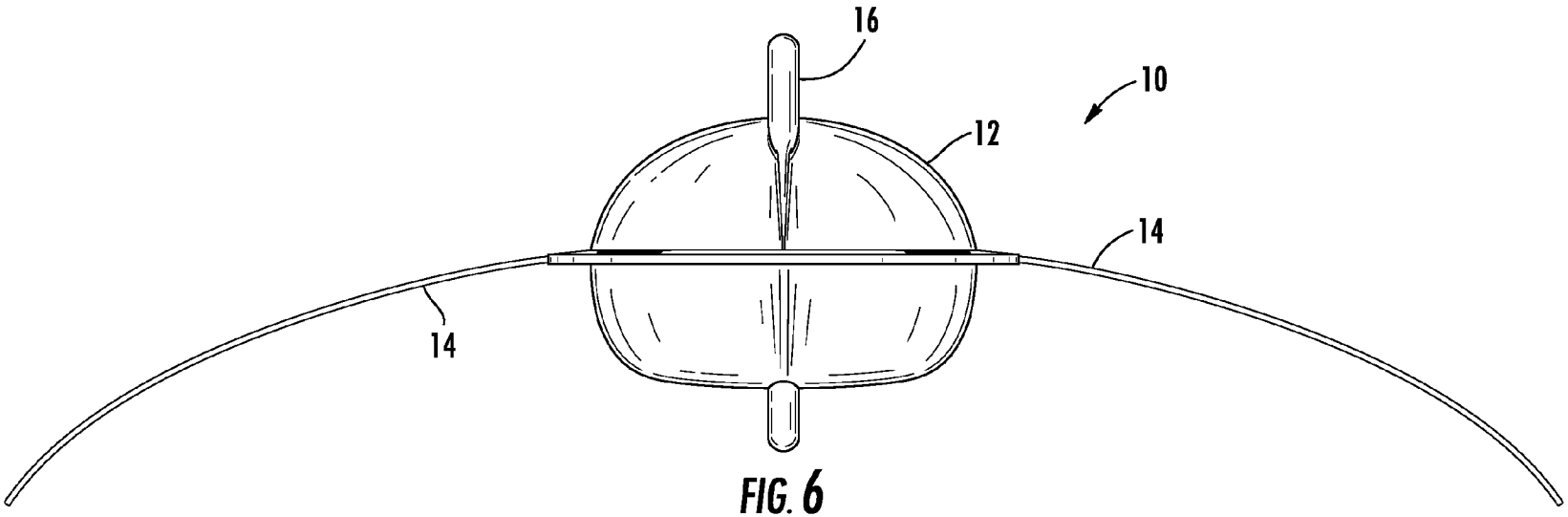
FIG. 6 is a front elevational view of the glider of FIG. 1.
Figure 8:
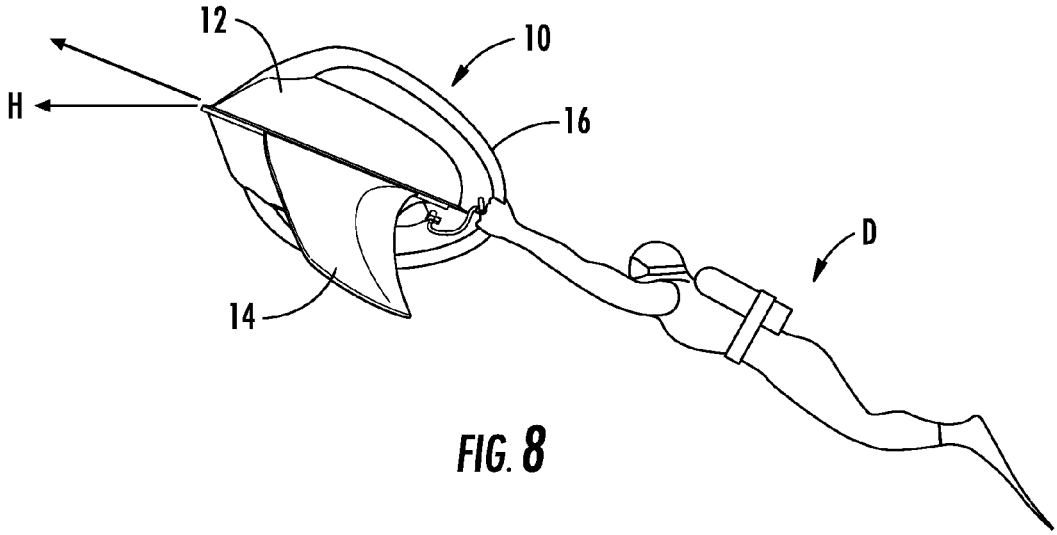
FIG. 8 is a side view of the glider of FIG. 1 with a diver in a climbing condition.

To rise or climb, as shown in FIG. 8, the diver D opens the valve 76 using the lever 78. Gas from the cylinders 72 fills the air chamber 36, giving the glider 10 positive buoyancy. The quantity of compressed gas needed depends upon the amount of weight that must be compensated for, the drag of the glider 10 and the diver, as well as the speed, distance, and rate of climb desired. Once the air chamber 36 is filled to the desired degree the diver closes the valve 76. This will cause the glider 10 to rise and to pitch in a nose-up direction. As it climbs, drag force acts on the wings 14 in a known manner to orient the glider 10 such that there is a horizontal component of motion. As shown in FIG. 8, there is a positive "deck angle" relative to the local horizontal "H", so that a gas bubble remains trapped in the air chamber 36. Also, as seen in FIG. 6, upwards motion of the body 12 causes downward deflection of the flexible wings 14 creating a significant anhedral angle. This improves lateral stability of the glider 10 and makes it easier for the diver D to control the glider's direction.

Figure 7:
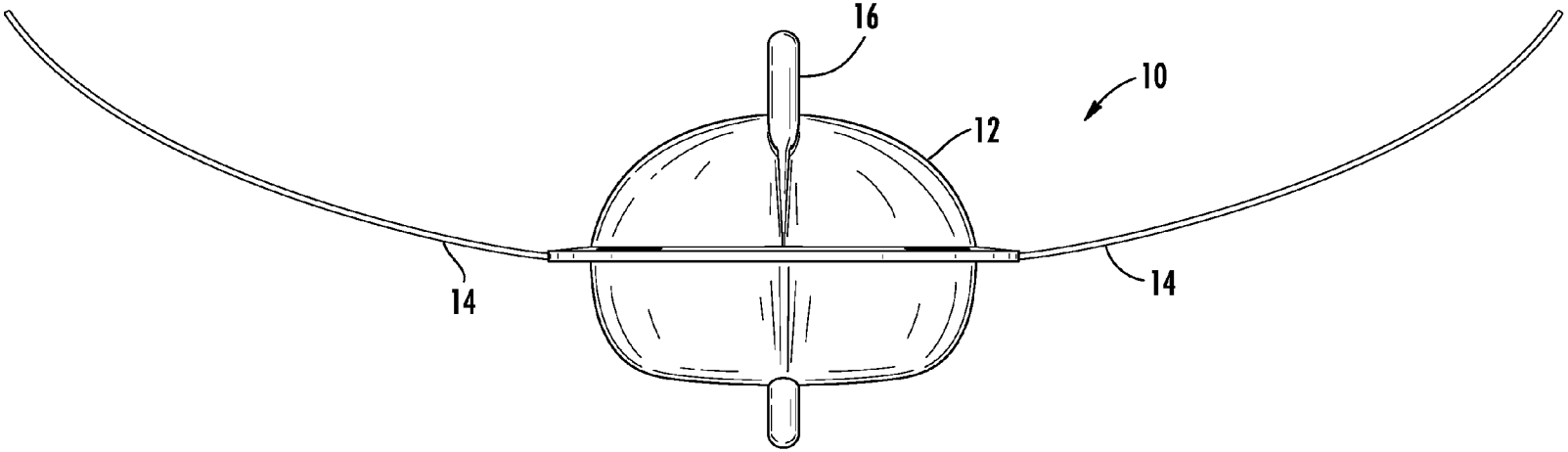
FIG. 7 is another front elevational view of the glider of FIG. 1 showing the wings thereof in a raised position.
Figure 9:
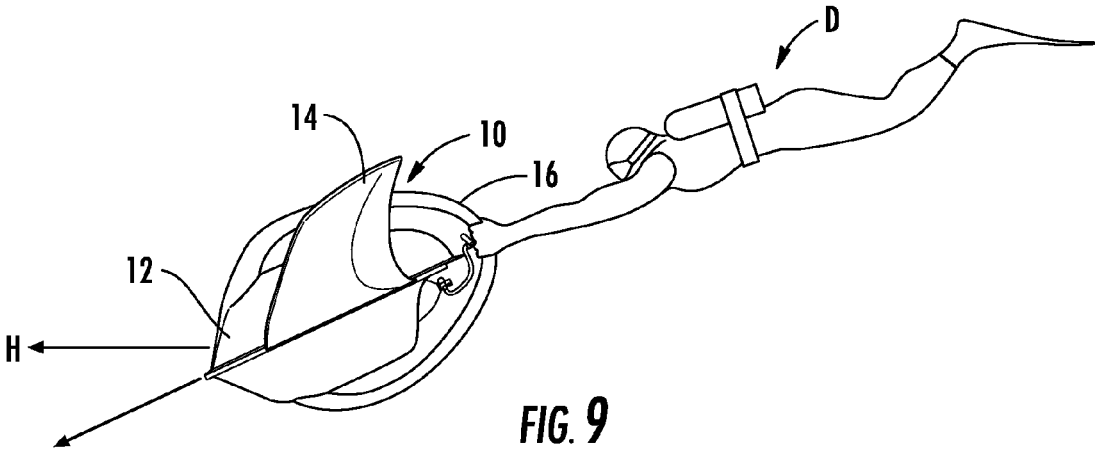
FIG. 9 is a side view of the glider of FIG. 1 with a diver in a diving condition.

To descend or dive once the glider 10 reaches the minimum desired depth, the diver D leaves the valve 76 closed and lowers his hand on the handle 16, causing the glider 10 to pitch down and have a negative "deck angle" relative to the local horizontal H (see FIG. 9). This exposes the outlet 38 and allows the bubble in the air chamber 36 to escape and water to flood into the air chamber 36. This gives the glider 10 negative buoyancy which tends to make it sink vertically down. As it descends, drag force acts on the wings 14 in a known manner to orient the glider 10 so there is a horizontal component of motion. Also, as seen in FIG. 7, downwards motion of the body 12 cause upward deflection of the wings 14 with a significant dihedral angle. This improves lateral stability of the glider 10 and makes it easier for the diver D to control the glider's direction.

Figure 10:
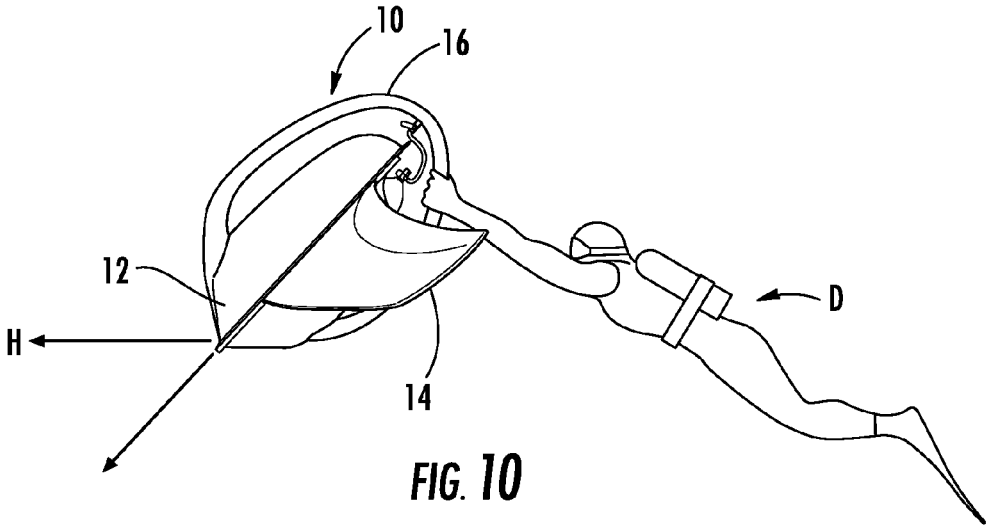
FIG. 10 is a side view of the glider of FIG. 1 with a diver pitching downwards from a climbing condition.
Figure 11:
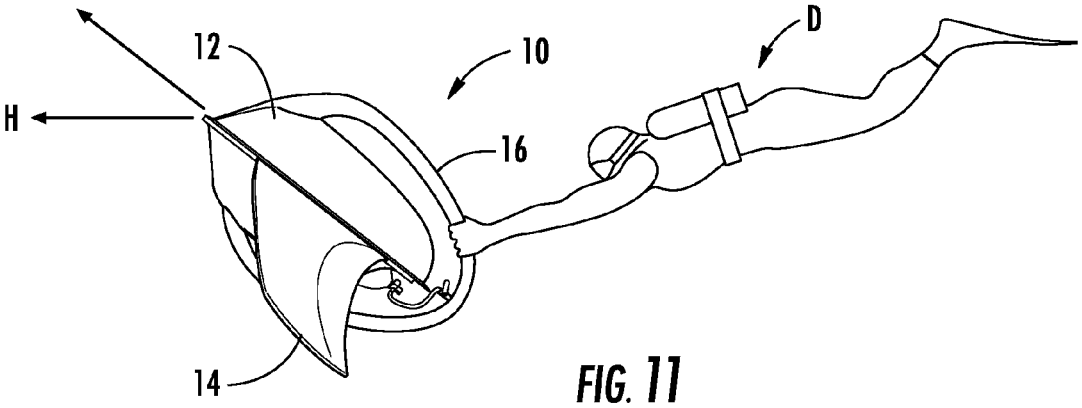
FIG. 11 is a side view of the glider of FIG. 1 with a diver pitching upwards from a diving condition.

The diver D can manipulate the pitch angle of the glider 10, and therefore its vertical trajectory, by way of his hand position on the handle 16. Placing the hand higher up and forwards on the handle 16 (seen in FIG. 11) tends to make the glider 10 pitch upwards, and placing the hand lower and forward on the handle 16 (seen in FIG. 10) tends to make the glider 10 pitch downwards. The change in the diver's hand position changes the diver's body position and the position of the center of drag of the diver D relative to the body 12. This provides significantly more pitch control "power" than if the diver D were to attempt to manipulate the pitch with his hand in one position on the handle 16. Typically the diver D could expect to make frequent small changes in hand position in order to control the vertical trajectory of the glider 10.

Lateral direction is controlled by rotation of the diver's wrist while holding onto the handle 16 to the desired direction, or while holding onto the handle 16 taking a second hand on the body 12 handle near one of the left or right sides 22 or 24, or while holding onto the handle 16 taking with a second hand on holding the wing 14 near the trailing edge 42 on the side of the desired direction of travel. The diver's hand position will be determined by the diver D depending on the degree of lateral direction change required.

The gliding cycle of climbing followed by diving can be repeated as long as the gas supply lasts. Tests have shown the glider 10 can achieve a glide ratio (i.e., the ratio of horizontal distance to vertical distance) of about 3:1. Tests have also shown that the glider 10 can travel about 122-183 m (400-600 ft.) for every 113 liters (4 $ft^3$) of air consumed. Practical operational runtime can be about one hour using the gas cylinders 72 described above.

The glider 10 described herein has several advantages over prior art underwater gliders. When gliding there are no sounds or electrical signals emitted from the glider 10. Only when dumping and filling the gas bubble from the air chamber 36 is any sound created. There are very few components that can fail or require maintenance and the compressed gas and weights are commonly found in every dive shop. Most other similar vehicles work on electric motors with a propeller and are high maintenance and extremely problematic. Further benefits over conventional similar machines is that there is no backwash from the propeller impacting the pilot while in motion, and in fact the pilot is riding in the slipstream of the glider 10 experiencing much less turbulence. Because of its composite construction and simple design, the glider 10 can be constructed at a low cost making it more affordable to the public.

The foregoing has described an underwater glider and a method for its operation. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. An underwater glider, comprising:

a body having a nose and a tail, opposed left and right sides, and spaced-apart upper and lower walls, the body including:

an interior space defined between the upper and lower walls that is configured to contain a gas vessel therein;

an air chamber defined in an upper portion of the body beneath the upper wall; and an outlet positioned in the body near the tail and below the upper wall, in communication with the air chamber;

a pair of wings extending from the left and right sides of the body, respectively; and a handle extending axially aft from the body, wherein the handle is generally a C-shape with a first end mounted to the upper wall of the body and a second end mounted to the lower wall of the body.

2. The glider of claim 1 further comprising a weight carried by the body.

3. The glider of claim 2 wherein the weight is received in a box mounted to the lower wall.

4. The glider of claim 1 wherein the body includes a bracket adapted to receive a generally cylindrical gas cylinder therein.

5. The glider of claim 1 wherein the first and second ends of the handle are mounted forward of a center of gravity of the glider.

6. The glider of claim 1 wherein the wings are resiliently flexible in an up-and-down direction.

7. The glider of claim 1 wherein the wings are of a symmetrical hydrofoil shape.

8. The glider of claim 1 wherein a center of gravity of the glider is positioned closer to the nose than to the tail.

9. The glider of claim 1 wherein a center of buoyancy of the glider is positioned closer to the nose than to the tail.

10. An underwater glider, comprising:

a body having a nose and a tail, opposed left and right sides, and spaced-apart upper and lower walls, the body including: an air chamber defined in an upper portion of the body beneath the upper wall; and an outlet positioned in the body near the tail and below the upper wall, in communication with the air chamber;

a gas cylinder mounted inside the body;

a valve coupled in fluid communication with the gas cylinder and the air chamber;

a pair of wings extending from left and right sides of the body, respectively, the wings being resiliently flexible in an up-and-down direction; and a handle extending axially aft from the body, wherein the handle is hollow and the valve communicates with an interior of the handle, which in turn communicates with the air chamber.

11. The glider of claim 10 further comprising at least one weight mounted to the lower wall.

12. The glider of claim 10 wherein the handle is generally a C-shape with a first end mounted to the upper wall of the body and a second end mounted to the lower wall of the body.

13. The glider of claim 12 wherein the first and second ends of the handle are mounted forward of a center of gravity of the glider.

14. A method of operating an underwater glider that comprises a body with a nose and a tail, the body including a gas vessel, an air chamber, an outlet positioned near the tail in communication with the air chamber, a pair of wings extending from left and right sides of the body, respectively, and a handle extending axially aft from the body, the method comprising:

(a) generating positive buoyancy in the glider by filling the air chamber with a gas bubble from the gas vessel;

(b) climbing upward through a body of water, wherein drag force acting on the wings generates a horizontal component of motion;

(c) pitching the glider to a nose-down position, so as to release the gas bubble from the air chamber through the outlet and allow water to fill the air chamber, thereby generating negative buoyancy in the glider; and (d) gliding downward through the body of water, wherein drag force acting on the wings generates a horizontal component of motion;

(e) wherein during operation of the underwater glider, a pitch angle of the glider is manipulated using at least one of: (1) selective pressure applied to the handle and (2) selective hand positioning applied to the handle.

15. The method of claim 14 wherein a center of gravity of the glider is biased forward so as to cause the glider to pitch nose-downwards when the glider's buoyancy is negative.

16. The method of claim 14 wherein a center of buoyancy of the glider is biased forward so as to cause the glider to pitch nose-upwards when the glider's buoyancy is positive.

17. The method of claim 14 wherein a valve is mounted on the handle and is coupled in flow communication with the gas vessel and the air chamber.

* * * * *